US005752479A

United States Patent [19]

Kinoshita et al.

[11] Patent Number: 5,752,479

[45] Date of Patent: *May 19, 1998

[54] VALVE OPERATING MECHANISM FOR 4-CYCLE ENGINE

[75] Inventors: Hisatoshi Kinoshita; Naoki Tsuchida, both of Iwata, Japan

[73] Assignee: Yamaha Hatsudoki Kabushiki Kaisha, Iwata, Japan

[ * ] Notice: The term of this patent shall not extend beyond the expiration date of Pat. No. 5,427,065.

[21] Appl. No.: 718,170

[22] Filed: Sep. 19, 1996

Related U.S. Application Data

[60] Continuation of Ser. No. 457,100, Jun. 1, 1995, abandoned, which is a division of Ser. No. 170,061, Dec. 8, 1993, Pat. No. 5,427,065.

[30] Foreign Application Priority Data

Dec. 8, 1992 [JP] Japan ..... 4-352089

[51] Int. Cl.[6] ..... F01L 1/18

[52] U.S. Cl. ..... 123/90.44; 123/90.27; 123/90.31

[58] Field of Search ..... 123/90.12, 90.15, 123/90.16, 90.17, 90.27, 90.31, 90.39, 90.44, 90.48, 90.6

[56] References Cited

U.S. PATENT DOCUMENTS

| | | | |
|---|---|---|---|
| 4,438,737 | 3/1984 | Burandt | 123/90.17 |
| 4,538,559 | 9/1985 | Imamura et al. | 123/90.6 |
| 4,617,881 | 10/1986 | Aoi et al. | 123/90.27 |
| 4,621,597 | 11/1986 | Kawada et al. | 123/90.27 |
| 4,883,026 | 11/1989 | Mansfield et al. | 123/90.16 |
| 4,934,348 | 6/1990 | Yagi et al. | 123/90.17 |
| 4,955,334 | 9/1990 | Kawamura | 123/90.11 |
| 4,969,427 | 11/1990 | Hamada | 123/90.27 |
| 4,974,560 | 12/1990 | King | 123/90.17 |
| 5,033,422 | 7/1991 | Kurisu et al. | 123/90.27 |
| 5,080,055 | 1/1992 | Komatsu et al. | 123/90.17 |
| 5,097,805 | 3/1992 | Uesugi et al. | 123/90.27 |
| 5,123,385 | 6/1992 | Sado et al. | 123/193.5 |
| 5,216,988 | 6/1993 | Taxon | 123/90.12 |
| 5,269,267 | 12/1993 | Beaumont | 123/90.16 |
| 5,327,856 | 7/1994 | Schroeder et al. | 123/90.11 |
| 5,427,065 | 6/1995 | Kinoshita et al. | 123/90.44 |

FOREIGN PATENT DOCUMENTS

| | | |
|---|---|---|
| 0333416 | 3/1989 | European Pat. Off. . |
| 0453416 | 10/1991 | European Pat. Off. . |
| 2552820 | 4/1985 | France . |
| 2659388 | 9/1991 | France . |
| 843329 | 7/1949 | Germany . |
| 2809915 | 9/1979 | Germany . |
| 4121504 | 3/1992 | Germany . |

OTHER PUBLICATIONS

European Search Report dated Feb. 28, 1994.

*Primary Examiner*—Weilun Lo

*Attorney, Agent, or Firm*—Knobbe, Martens, Olson & Bear LLP

[57] ABSTRACT

A number of embodiments of valve actuating mechanisms for four-cycle engines including a camshaft and a rocker arm actuated by the camshaft for operating an associated poppet valve. The camshaft and rocker arm followers are configured so as to provide an increasing lever ratio on valve opening for effective rapid valve opening and a decreased lever ratio on valve closing so as to avoid valve bounce. Various arrangements of camshafts and rocker arm positions are disclosed.

7 Claims, 6 Drawing Sheets

VALVE OPERATING MECHANISM FOR 4-CYCLE ENGINE

This application is a continuation of U.S. patent application Ser. No. 08/457,100, filed Jun. 1, 1995, now abandoned, which was a divisional of U.S. patent application Ser. No. 08/170,061, filed Dec. 8, 1993, now U.S. Pat. No. 5,427,065.

BACKGROUND OF THE INVENTION

This invention relates to a valve operating mechanism for a four-cycle engine and more particularly to an improved valve operating mechanism for such engines.

As is well-known, the performance of an engine is directly related to its ability to breathe. That is, the ability to induct a large charge in a short time period and also exhaust a large charge in a short time period is important to the development of good power for the engine. This requires rapid opening of the intake and exhaust valves. Normally, the valves are operated either directly by the cam lobes, or, in many instances, the valves are operated by a rocker arm which is in turn operated by the cam. There are some advantages in being able to employ rocker arm so as to amplify the motion of the valves from that permitted by the cam configuration. However, in order to provide rapid opening of the valves through a rocker arm actuator, it is necessary to form a concave configuration on the cam lobe in the ramp leading to the fully-opened position. However, such concave cam configurations are difficult to form and require special grinding tool.

In a like manner, there is a desirability to close the intake and exhaust valves at a less rapid rate than they are opened. The reason for this is that rapid closure of the intake and exhaust valves can cause bouncing of the valve. That is, if the valve is closed too rapidly, the impact with the valve seat may cause the valve to bounce open. Although this can be avoided through the use of heavy springs, these heavy springs increase the load on operation of the valve train and can cause reduced power.

In order to provide restricted rate of closure of the valves along with rapid opening, it has also been necessary to form concave cam profiles which have the defects as aforenoted.

It is, therefore, a principal object of this invention to provide an improved valve operating mechanism for an internal combustion engine.

It is a further object of this invention to provide an improved cam and rocker arm valve actuating system wherein rapid rates of valve opening and slower rates of valve closing can be accomplished without using especially formed cam lobes.

It is a further object of this invention to provide an improved follower surface configuration for a valve actuating rocker arm that permits rapid opening and slow closing with relatively conventional and easily formed cam lobe configurations.

SUMMARY OF THE INVENTION

This invention is adapted to be embodied in a valve operating system for an internal combustion engine which comprises a poppet valve supported for reciprocatory motion between an open position and a closed position for controlling the flow through a passage communicating with a combustion chamber of the engine. A cam is rotatable about an axis. A rocker arm is supported for pivotal movement about an axis and has a portion engaged with the stem of the valve for operating the valve in response to pivotal movement of the rocker arm. A follower surface is formed on the rocker arm which is engaged by the cam for pivoting the rocker arm about its pivot axis for operating the valve. The follower surface is configured to provide a greater leverage ratio upon movement of the rocker arm to effect movement of the poppet valve in one direction.

DETAILED DESCRIPTION OF THE PREFERRED EMBODIMENTS OF THE INVENTION

Figure 1:
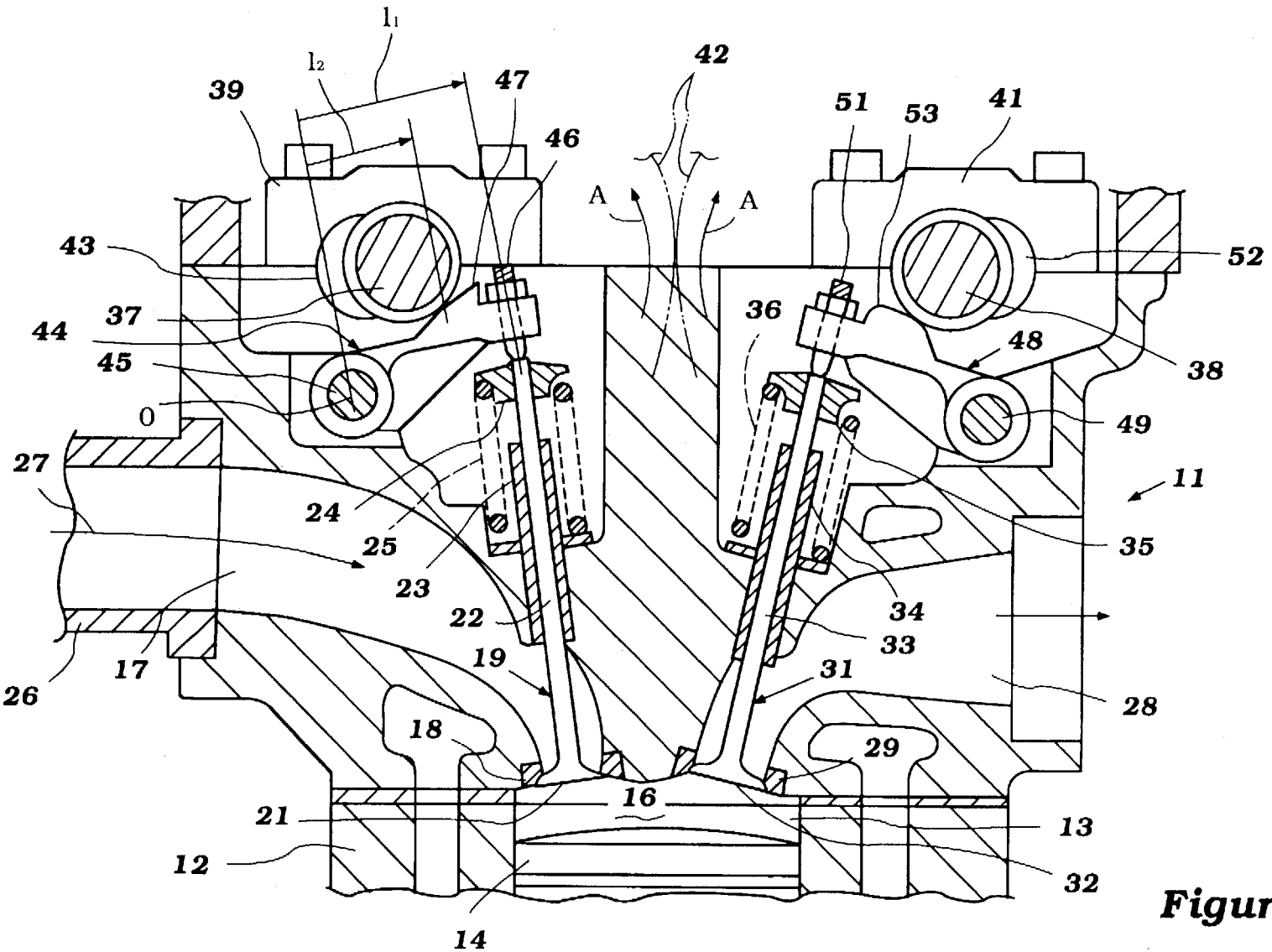
FIG. 1 is a partial cross-sectional view taken through a single cylinder of an internal combustion engine constructed in accordance with a first embodiment of the invention.
Figure 2:
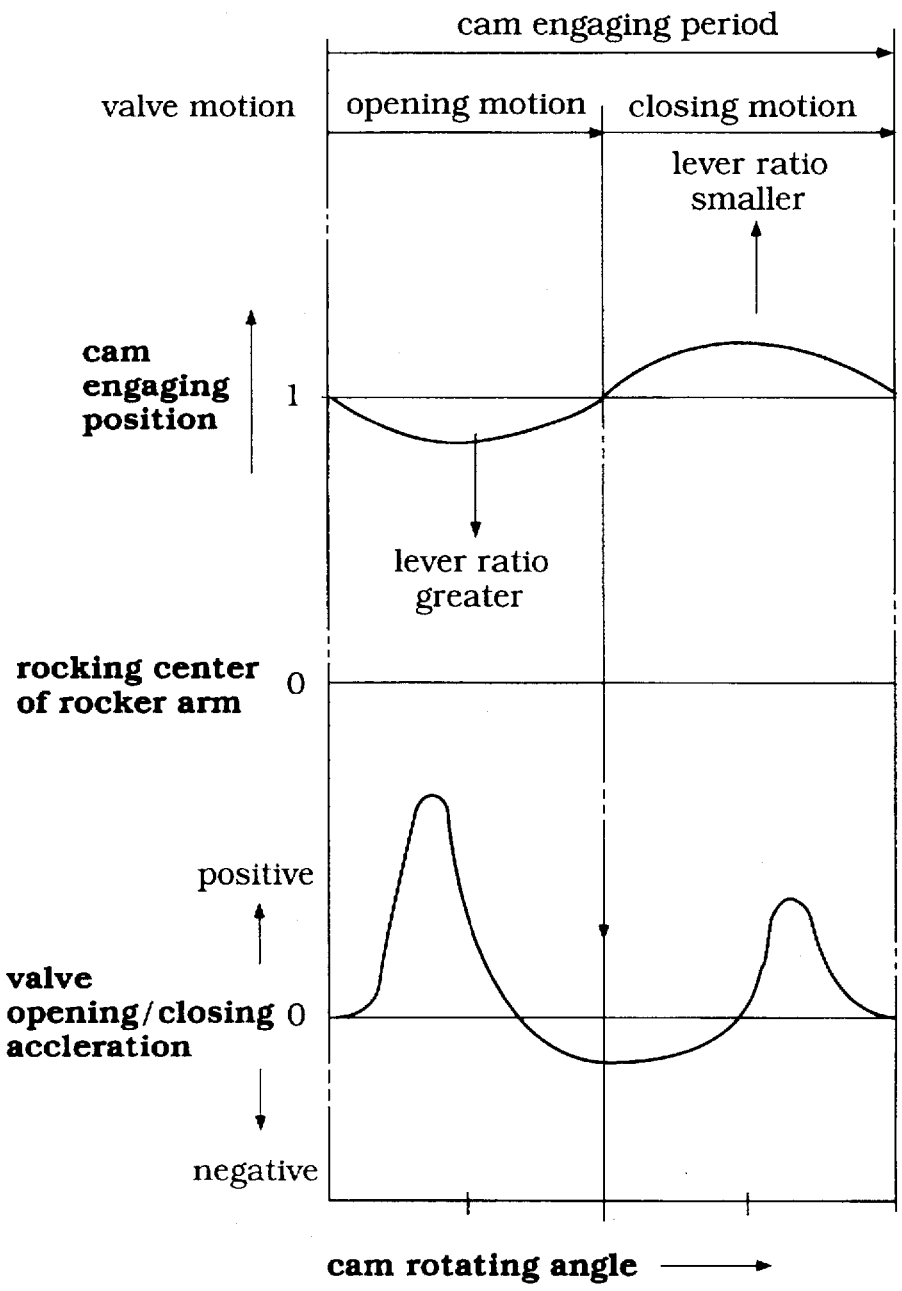
FIG. 2 is a graphical view showing the camshaft rotation angle during the period when the valve is being actuated and shows the lever ratio and acceleration of the valve actuating mechanism and of the valve itself.

Referring now in detail to the drawings and initially to FIGS. 1 and 2, an internal combustion engine constructed in accordance with this embodiment of the invention is identified generally by the reference numeral 11. The engine 11 is shown only partially and in cross section because the invention deals with the valve actuating system for the engine. For this reason, only a portion of a single cylinder of the engine is necessary to understand the construction and operation of the invention. Any details which are not disclosed with respect to the basic structure of the engine may be considered to be conventional.

The engine 11 is comprised of a cylinder block 12 defining one or more cylinder bores 13 which may have any relationship (in-line, V-type, etc.) and which support pistons 14 for reciprocation. The pistons 14 are connected in a well-known manner to connecting rods so as to drive a crankshaft, as is well-known in this art.

A cylinder head assembly, indicated generally by the reference numeral 15, is affixed to the cylinder block 12 in any known manner. The cylinder head 15 is provided with combustion chamber recesses 16 which cooperate with the cylinder bore 13 and pistons 14 so as to form the combustion chambers of the engine.

One or more intake passages 17 extend through one side of the cylinder head assembly 15 and terminate at valve seats 18 which are pressed or otherwise affixed to the cylinder head 15. Poppet-type intake valves 19 cooperate with the valve seats 18 and control the flow through the intake passages 17. These intake poppet valve 19 have head portions 21 which open and close engagement with the valve seats 18 and stem portions 22 that are supported for reciprocation within the cylinder head 15 by means of pressed-in valve guides 23. A keeper retainer assembly 24 is affixed to the upper end of the intake valve stems 22 and loads a coil compression spring 25 which normally urges the intake valves 19 to their closed positions. The manner in which the intake valves 19 are opened and closed will be described later.

A suitable induction system (not shown) which includes a manifold having runners 26 is affixed to the intake side of the cylinder head 15 and supplies an air charge flowing as indicated by the arrow 27.

One or more exhaust passages 28 are formed in the other side of the cylinder head 15 and extend from valve seats 29 which are pressed or otherwise fixed to the cylinder head 15 in communication with the combustion chamber recess 16. Poppet-type exhaust valves, indicated generally by the reference numeral 31, have head portions 32 that cooperate with the valve seats 29 so as to open and close communication of the combustion chamber cavity 16 with the exhaust passage 28. These exhaust valves 31 have their stem portions 33 slidably supported within valve guides 34 that are fixed in a suitable manner to the cylinder head 15.

Keeper retainer assemblies 35 are affixed to the upper end of the exhaust valve stems 33 and load of coil compression springs 36 which urge the exhaust valves 31 to their closed position. The mechanism for opening and closing the exhaust valves 31 as well as the system for opening and closing the intake valves 19 will now be described.

Mounted for rotation in the cylinder head assembly 15 are an intake camshaft 37 and an exhaust camshaft 38. The intake and exhaust camshafts 37 and 38 are journalled by respective bearing surfaces formed by the cylinder head 35 and by bearing caps 39 and 41, respectively affixed to the cylinder head 15 along the length of the camshafts 37 and 38. Any known type of bearing system may be employed for the support of the camshafts 37 and 38.

One of the camshafts 37 and 38 is driven directly from the engine crankshaft at one-half crankshaft speed by any known type of drive mechanism. The camshafts 37 and 38 carry a pair of intermeshing gears 42 which effectively drive the non-crankshaft driven camshaft from the crankshaft driven camshaft. Because of the intermeshing gears 42, the camshafts 37 and 38 will rotate in opposite directions from each other as indicated by the arrows A. In this embodiment, the intake camshaft 37 rotates in a counter-clockwise direction while the exhaust camshaft 38 rotates in a clockwise direction.

The intake camshaft 38 has cam lobes 43 which, as may be readily apparent from FIG. 1, have a generally cylindrical configuration, with their axis offset from the axis of rotation of the intake camshaft 37. Hence, the cam lobes 43, because of this generally cylindrical configuration, can be easily formed by a grinding operation without requiring special grinding mechanisms or grinding wheels. This is made possible for a reason now to be described.

Intake rocker arms 44 are pivotally supported on a rocker arm shaft 45 that is mounted to the cylinder head assembly 15 in a known manner, and which defines a pivot axis O. These rocker arms 44 carry follower adjusting screws 46 at their outer ends which engage the tips of the intake valve stems 22 for opening and closing these valves 19. The follower screws 46 are adjustable, in a known manner, so as to adjust the valve clearance.

In accordance with the invention, the rocker arms 44 are provided with a follower surface 47 that is disposed between the pivot axis O and a point $L_1$ where the followers 46 contact the valve stems 22. The follower surface 47 has a gradually upwardly tapered curved surface as clearly shown in FIG. 1 that provides an area which, when contacted by the cam lobe 43, as the camshaft 37 rotates in opening direction will provide a point of contact that moves progressively closer from the heel engagement $L_2$ toward the pivot axis O as shown in FIG. 2. As the point of contact moves closer to the pivot axis O, there will be established a lever ratio that offers an increasing leverage so that a given degree of movement of the cam lobe 43 will provide a greater degree of movement of the intake valve 19 in its opening direction as shown in FIG. 2. This provides a very quick acceleration of the intake valve 19 in its opening direction as also shown in this figure so as to provide a rapid opening of the intake valve 19 and, accordingly, good breathing.

As the camshaft 37 continues to rotate and the lobe 43 moves past its high point, then the leverage ratio will actually become smaller as the point of contact moves along the follower surface 47 away from the pivot axis O so as to provide a reduced lever ratio from that on that opening side. As a result, the intake valve 19 will be closed at a slower rate by the springs 25 acting to hold the rocker arm 44 in engagement with the cam lobe 43 as also shown in this figure. As a result, by the time the intake valves 19 reach their closed position with their heads 21 engaging the valve seats 18, there will be very low velocity and hence bouncing of the valves will be avoided. This provides better performance and ensures against loss of compression due to valve bouncing.

An exhaust rocker arm 48 is mounted on the exhaust side of the cylinder head 15 upon a rocker arm shaft 49 which is carried by the cylinder head 15 in a known manner. The outer end of the exhaust rocker arms 48 carry adjusting follower screws 51 which are engaged with the stems 33 of the exhaust valves 31 for controlling their movement.

The exhaust camshaft 38 is formed with an exhaust cam lobe 52 which has a configuration similar to the intake cam lobe 43. That is, the exhaust cam lobe 52 is generally a cylindrical configuration and thus can be easily formed by conventional grinding apparatus and grinding wheels, unlike the prior art type of construction. Between the adjusting screw 51 and the pivot axis defined by the rocker arm shaft 49, the exhaust rocker arms 48 are formed with follower surfaces 53 which are configured so as to provide lever ratio and lift acceleration rate as shown in FIG. 2. However, since the exhaust camshaft 38 rotates in an opposite direction from the intake camshaft, the shape of the rocker arm follower surface 53 is different than the follower surface 47 of the intake rocker arms 44.

Figure 3:
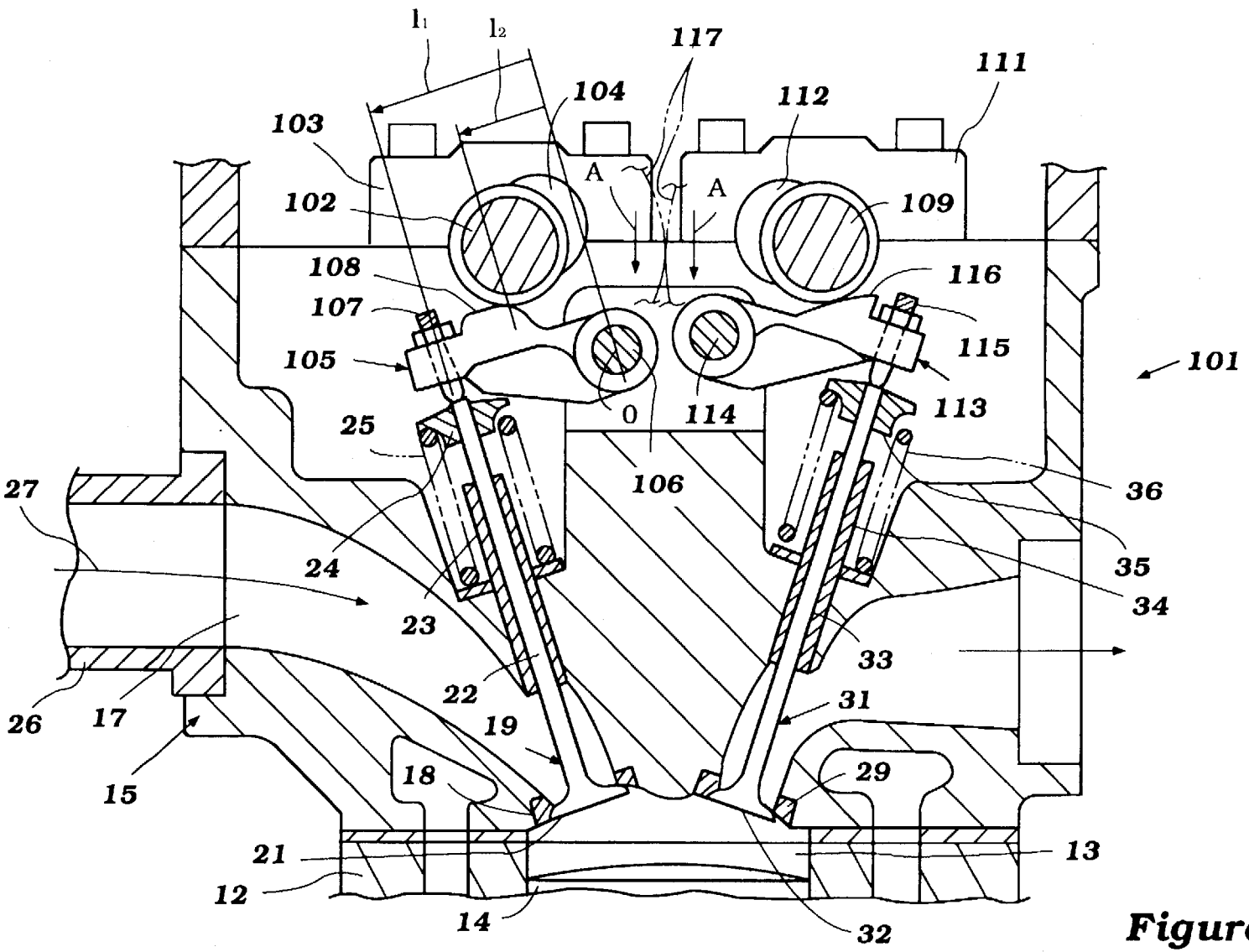
FIG. 3 is a partial cross-sectional view, in part similar to FIG. 1, and shows another embodiment of the invention.

Another embodiment of the invention is shown in FIG. 3 and the basic components of the engine in this embodiment, which is indicated generally by the reference numeral 101 have the same configuration and construction as the previously described embodiment. For that reason, those components which are the same have been identified by the same reference numerals and will be described again only insofar as is necessary to understand the construction and operation of this embodiment.

As will become apparent, the differences between this embodiment (engine 101) and the engine 11 of the embodiment of FIG. 1 is that the intake and exhaust camshafts rotate in opposite directions from those in the previously described embodiments and the intake and exhaust rocker arms are mounted in the area between the respective intake and exhaust valves 19 and 31 rather than outward thereof, as in the previously described embodiment.

In this embodiment, an intake camshaft 102 is rotatably journalled in the cylinder head assembly 15 by a means of bearing cap 103 about a rotational axis that is disposed in the area between the tips of the stems 22 and 33 of the intake and exhaust valves 19 and 31, respectively. As with the previously described embodiment, the intake camshaft 102 has cam lobes 104 which are generally cylindrical in configuration.

Intake rocker arms, indicated generally by the reference numeral 105, are supported for pivotal movement about a pivot axis O by means of an intake rocker arm shaft 106 that is disposed centrally of the cylinder head 15. An adjusting screw follower 107 is carried at the outer end of the intake rocker arms 105 and contacts the tips of the valve stems 22 for operating the intake valves 19. A follower surface 108 having a configuration similar to the follower surface 53 of the exhaust camshaft 48 of the previously described embodiment is provided and is engaged by the cam lobe 104 so as to provide a varying lever ratio and acceleration curve as shown in FIG. 2.

An exhaust camshaft 109 is supported on the opposite side of the cylinder head 15 but inwardly of the exhaust valves 31 by means of bearing caps 111 in a well-known manner. The exhaust camshaft 109 has cam lobe 112 which are generally cylindrical in configuration.

These cam lobes 112 cooperate with exhaust rocker arms 113 that are mounted for pivotal movement about the cylinder head 15 on a rocker arm shaft 114 which is juxtaposed to the intake rocker arm shaft 106. Adjusting screw followers 115 are threaded into the outer ends of the exhaust rocker arms 113 and engage the tips of the exhaust valve stems 33 for their operation. A follower surface 116 having a configuration like the intake rocker arm follower surface 47 of the previously described embodiment is positioned between the ends of the exhaust rocker arms 113 and cooperates with the exhaust cam lobe 112 to provide a lever ratio and lift characteristics as shown in FIG. 2.

Like the previously described embodiment, the intake and exhaust camshafts 102 and 109 carry intermeshing gears 117 so that the camshaft 102 and 109 will rotate in opposite direction. In this embodiment, however, the exhaust camshaft 102 rotates in a clockwise direction and the exhaust camshaft 109 rotates in a counter-clockwise direction. Any known type of drive may be provided for driving one of the camshafts 102 and 109 in the appropriate direction and at one-half crankshaft speed.

Figure 4:
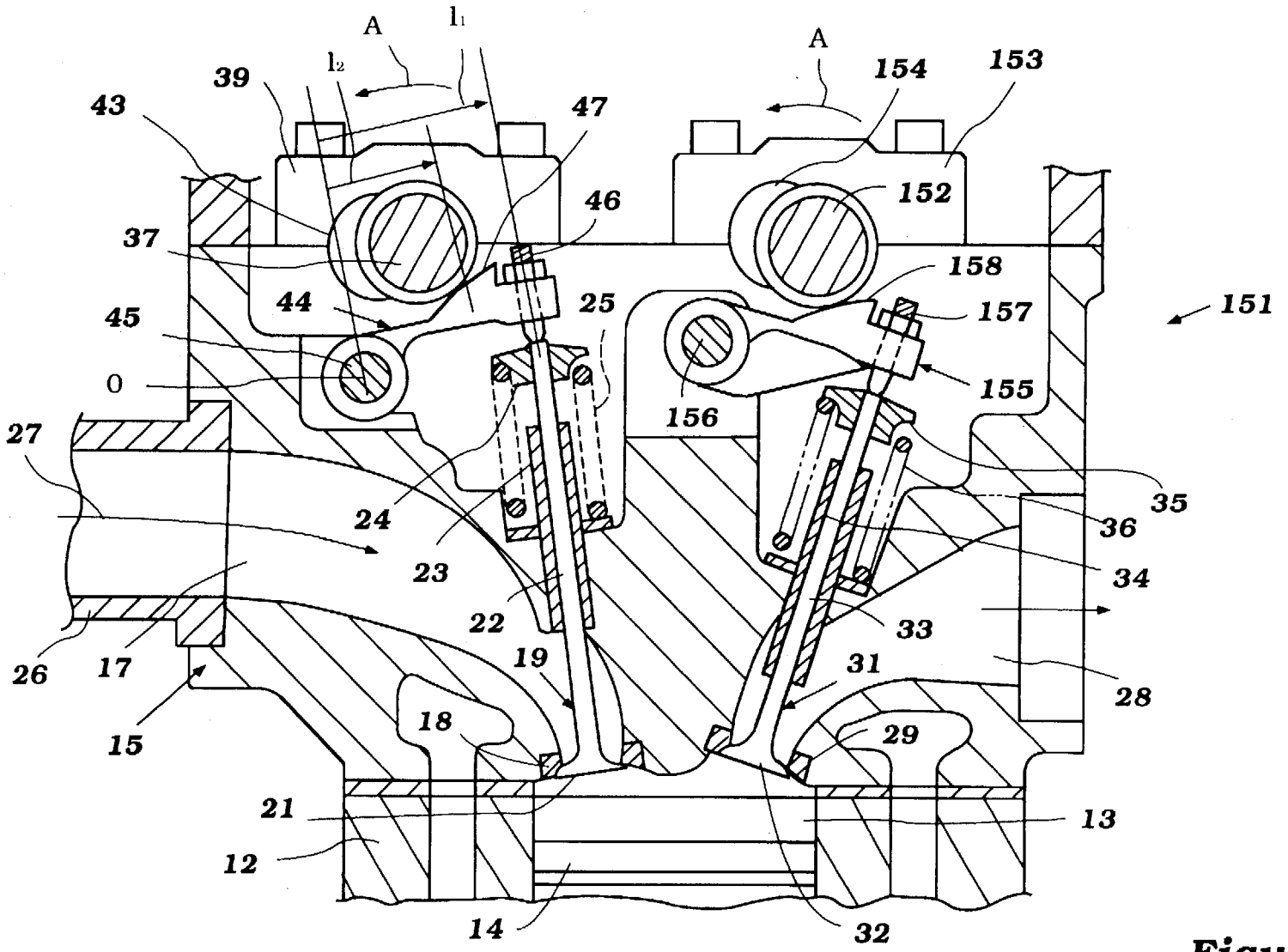
FIG. 4 is a cross-sectional view, in part similar to FIGS. 1 and 3, and shows a third embodiment of the invention.

An engine constructed in accordance with another embodiment of the invention is shown in FIG. 4 and is identified generally by the reference numeral 151. This embodiment is similar to the embodiment of FIG. 1, but in this embodiment, the intake and exhaust camshafts are driven in such a manner so that they both rotate in the same direction. Because this is the only difference between this embodiment and that of FIG. 1, components of this embodiment which are the same as the previously described embodiment of FIG. 1 have been identified by the same reference numerals and will not be described again, except insofar as is necessary to understand the construction and operation of this embodiment. Also, since the intake camshaft 37 in this embodiment rotates in the same counterclockwise direction as the embodiment of FIG. 1, the rocker arm and valve actuating system is exactly the same as that previously described in conjunction with the embodiment of FIG. 1, and thus further description of it is not believed to be necessary.

The exhaust camshaft 152 is rotatably journalled by means of bearing caps 153 and has cam lobes 154 which, like the cam lobes of all of the previously described embodiments, are generally cylindrical. As has been noted, however, in this embodiment, the exhaust camshaft 152 rotates in the same counterclockwise direction as the intake camshaft 37 these rotational directions being shown by the arrows A. As a result of this, an exhaust rocker arm, indicated generally by the reference numeral 155 may be employed which has the same configuration as the intake rocker arm 44. This exhaust rocker arm 155 is pivotally supported on an exhaust rocker arm shaft 156 that is carried suitably in the cylinder head but is disposed opposite to the position of the exhaust rocker arm 48 of the embodiment of FIG. 1 so as to permit the same configuration to be employed for both intake rocker arm 44 and exhaust rocker arm 155.

The outer end of the exhaust rocker arms 155 carry adjusting and follower screws 157 that are engaged with the tips of the exhaust valve stems 33 for operating them. A follower surface 158 is formed on exhaust rocker arms 155 between the adjusting screws 157 and the rocker arm shaft 156 and has the same shape as the follower surfaces 47 of the intake rocker arms 44 so as to provide the lever ratio and lift curves as shown in FIG. 2.

Figure 5:
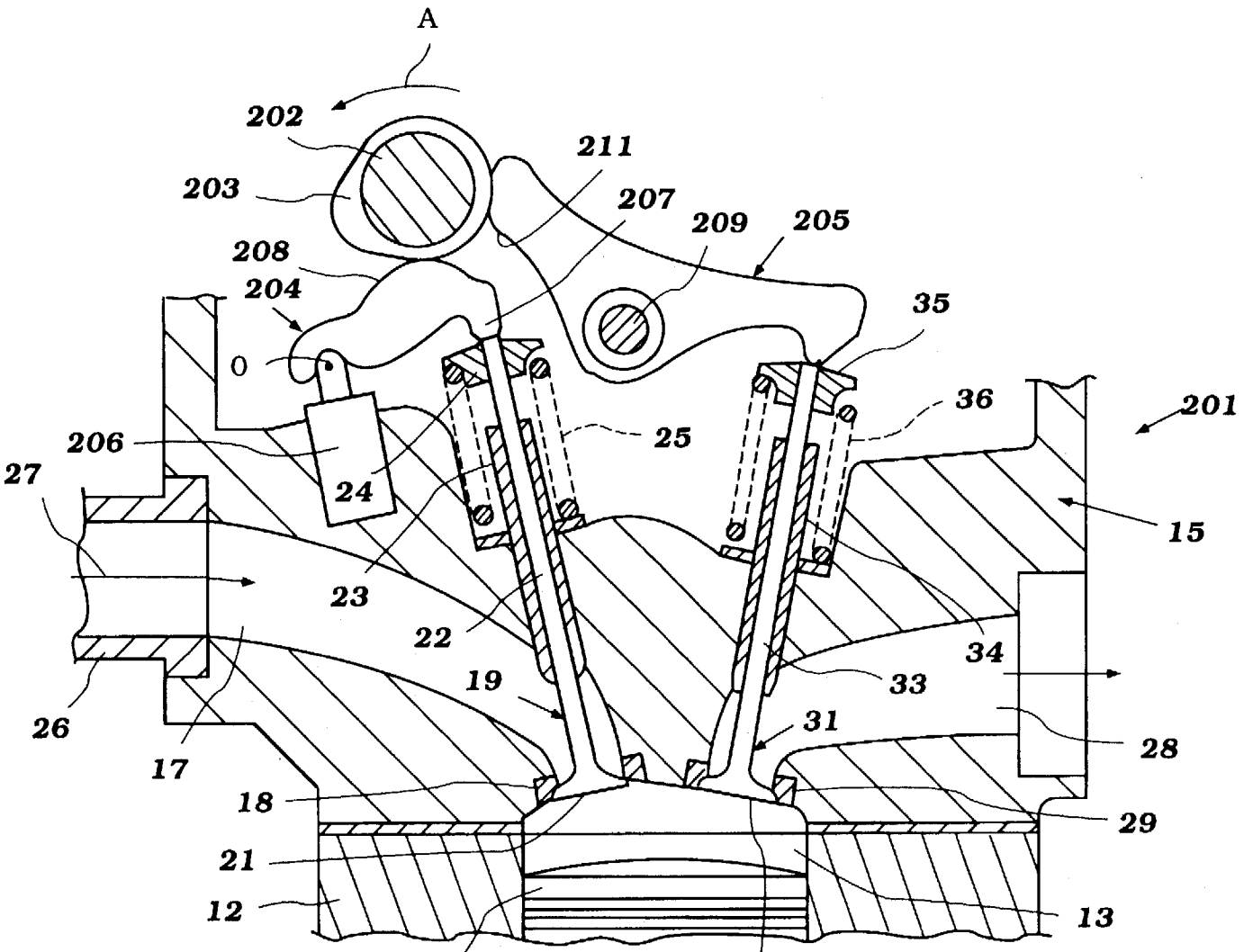
FIG. 5 is a cross-sectional view, in part similar to FIGS. 1, 3 and 4, and shows a fourth embodiment of the invention.

All of the embodiments as thus far described as illustrated in configuration that employs a separate camshaft for operating both the intake and the exhaust valves. However, this invention may also be employed with single cam engines and such an embodiment is shown in FIG. 5 wherein the engine is identified generally by the reference numeral 201. The basic construction of the cylinder block and cylinder head and intake and exhaust ports is the same as the previously described embodiments and, for that reason, components which are the same or substantially the same have been identified by the same reference numerals and will not be described again, except insofar as is necessary to understand the construction and operation of this embodiment.

In this embodiment, a single camshaft 202 is rotatably journalled in the cylinder head 15 on the intake side thereof. This single camshaft 202 is driven at one-half crankshaft speed by any suitable mechanism and rotates in the direction of the arrow A in FIG. 5. The camshaft 202 has a plurality of cam lobes 203 that cooperate with intake rocker arms 204 for operating the intake valves 19 and exhaust rocker arms 205 that operate the exhaust valves 31.

The intake rocker arms 204 are pivotally supported about a pivot axis O on a hydraulic lash adjuster 206 that is mounted in the cylinder head 15 on the intake side of the engine and which is supplied with hydraulic pressure from a suitable source. This rocker arm 204 has a tip 207 that is engaged with the tips of the intake valve stems 22 for opening and closing them under the control of the cam lobes 203. It should be noted that since the hydraulic lash adjuster 206 is provided, no adjusting screw is required in this embodiment.

Intermediate the valve engaging tip 207 and the pivot axis 0, the rocker arms 204 are provided with follower surfaces 208 that are engaged by the cam lobes 203 and are configured so as to provide acceleration and lever ratio curves as shown in FIG. 2. It should be noted that in this embodiment, the cam lobes 203 are more conventional in having a generally egg shape. However, this can be done without any special grinding techniques or grinding tools, and the configuration of the follower surface 208 provides the desired lift curves.

The exhaust rocker arm 205 is mounted on a rocker arm shaft 209 that is supported in the cylinder head 15 in any known manner. The rocker arm 205 in this embodiment has its pivot axis between its ends, but it is provided with a follower portion 211 which is configured so as to cooperate with one of the cam lobes 203 to again provide a varying lever ratio and lift, as with the other embodiments. Depending upon the valve timing, each intake rocker arm 204 and exhaust rocker arm 205 may cooperate with the same or a different lobe 203 on the camshaft 202.

Figure 7:
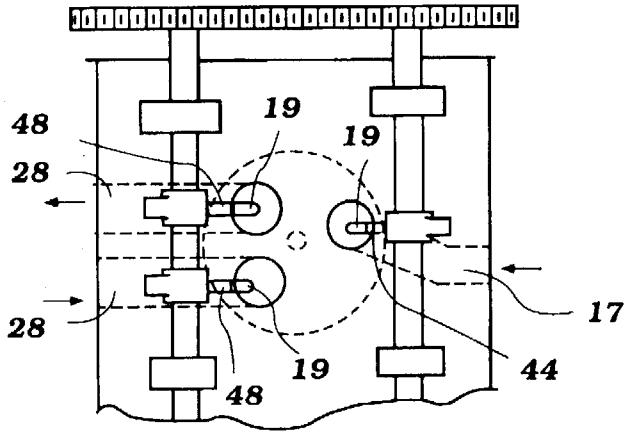
FIG. 7 is a top plan view, in part similar to FIG. 6, showing a layout for two intake valves and one exhaust valve for a single cylinder with the intake valves being disposed on opposite sides of the cylinder bore axis.
Figure 6:
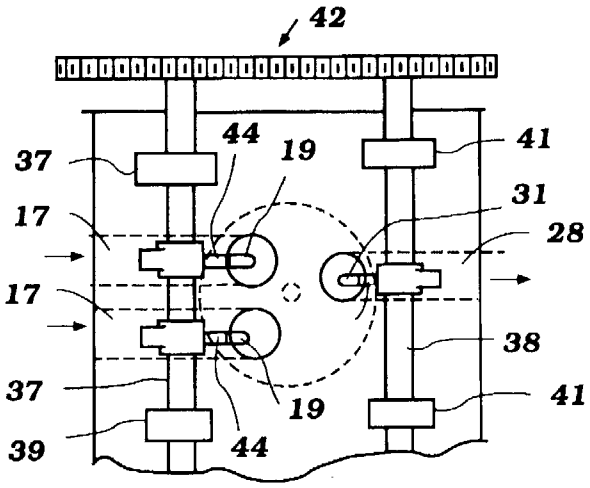
FIG. 6 is a top plane view showing the layout for an arrangement employing two intake valves and one exhaust valve per cylinder.
Figure 8:
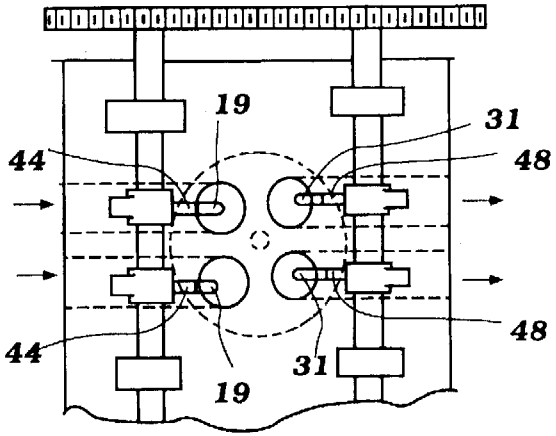
FIG. 8 is a top plan view, in part similar to FIGS. 6 and 7, and shows an embodiment with four valves per cylinder and a cross flow pattern.

As previously noted, the invention may be employed with any number of intake and exhaust valves although the described embodiments have referred to only a single intake valve and a single exhaust valve for each cylinder of the engine. In these embodiments, it has been assumed that the intake valves are all positioned on one side of an axis containing the center of the cylinder bore 13 and the exhaust valves have all been positioned on the other side of this axis. Also, when the intake and exhaust valves have been operated by separate camshaft, the respective camshafts have been disposed on the same side of the axis as their valves which they actuate. Of course, in the embodiment of FIG. 5, the camshaft 202 for both the intake and exhaust valves has been disposed on the intake side of the camshaft. FIGS. 6 through 8 show a number of embodiments employing multiple valves and these differ from what has already been described only in the valve placement and the flow pattern through the cylinder head. For this reason, these embodiments have employed the same reference numerals so as to indicate corresponding parts from the embodiments as thus far described.

FIG. 6 shows an arrangement embodying two intake valves operated by a common intake camshaft on one side of the cylinder head and a single exhaust valve operated by an exhaust camshaft on the opposite side of the cylinder head. The direction of rotation of the camshafts is opposite and they may be in either the direction as shown in FIG. 1 or in the direction as shown in FIG. 3.

FIG. 7 shows an embodiment wherein one intake valve is positioned on each side of the cylinder bore axis and the exhaust valve is positioned on one side of the cylinder bore axis. Thus, this provides an intake and exhaust flow as shown by the arrows in this figure. In this embodiment, of course, one camshaft operates the single intake valve with each cylinder and the other camshaft operates one intake valve and one exhaust valve.

FIG. 8 shows another embodiment having a cross flow pattern with two intake valves and two exhaust valves per cylinder.

It should be obvious from the foregoing description that the invention may be employed in conjunction with engines having any number of intake and exhaust valves and any valve placement.

In any of the embodiments as thus far described dealing with the twin cam versions, there may be provided an adjusting mechanism in either the intake and/or exhaust camshaft drive that provides variable valve timing. If this is done, it is not necessary to provide as much overlap as with conventional valve actuating mechanisms due to the fact that the intake and exhaust valves open faster and close slower. Hence, there will be less necessity for using variable valve timing with the described arrangements than with more conventional constructions that are limited by the configuration of the camshaft in conjunction with the valve opening and closing operation.

It should be readily apparent from the foregoing description that the described embodiments are extremely effective in providing very quick valve opening and somewhat slower valve closing so as to improve breathing efficiency without attendant valve bouncing and without requiring special cam lobe forming techniques and tools. Of course, the foregoing description is that of preferred embodiments of the invention and various changes and modifications may be made without departing from the spirit and scope of the invention, as defined by the appended claims.

We claim:

1. A valve operating system for an internal combustion engine comprised of a poppet valve supported for reciprocatory motion between an open position and a closed position for controlling the flow through a passage communicating with a combustion chamber of the engine, a cam rotatable about an axis, and a direct mechanical motion transmitting means interposed between said cam and the stem of said valve for effecting operation of said valve upon rotation of said cam, said cam and said direct mechanical motion transmitting means being configured to provide more rapid initial movement of said poppet valve in one direction in response to a given rotation of said cam than the initial movement in other direction and for a substantial part of the rotation of said cam.

2. The valve operating system of claim 1, wherein the rapid movement occurs on valve opening and the slower movement occurs on valve closing.

3. The valve operating system of claim 1, further including a second poppet valve supported for reciprocatory motion between an open position and a closed position for controlling the flow through a second passage communicating with the same combustion chamber of the engine as the first mentioned passage, a second cam rotatable about an axis, second direct mechanical motion transmitting means interposed between said second cam and the stem of said second valve for effecting operation of said second valve upon rotation of said second cam, said second cam and said second direct mechanical motion transmitting means being configured to provide a greater speed of movement of said second poppet valve in one direction in response to a given rotation of said second cam than in the other direction.

4. The valve operating system of claim 3, wherein the cams are provided on separate camshafts and rotational axes of the camshafts are disposed on opposite sides of the combustion chamber.

5. The valve operating system of claim 4, wherein the camshafts rotate in opposite directions.

6. The valve operating system of claim 4, wherein one of the camshafts operates at least a pair of intake valves for the same cylinder.

7. The valve operating system of claim 6, wherein the valves operated by the other of the camshafts comprise exhaust valves for the same cylinder.

* * * * *